US010455957B2

(12) United States Patent
Wang et al.

(10) Patent No.: US 10,455,957 B2
(45) Date of Patent: Oct. 29, 2019

(54) HEALTH PILLOW

(71) Applicants: Wei-Hsuan Wang, Taipei (TW); Wei-Chien Wang, Taipei (TW); Wei-Chun Wang, Taipei (TW); Po-Shih Wang, Taipei (TW)

(72) Inventors: Wei-Hsuan Wang, Taipei (TW); Wei-Chien Wang, Taipei (TW); Wei-Chun Wang, Taipei (TW); Po-Shih Wang, Taipei (TW)

( * ) Notice: Subject to any disclaimer, the term of this patent is extended or adjusted under 35 U.S.C. 154(b) by 245 days.

(21) Appl. No.: 15/415,634

(22) Filed: Jan. 25, 2017

(65) Prior Publication Data

US 2018/0184822 A1 Jul. 5, 2018

(30) Foreign Application Priority Data

Dec. 30, 2016 (TW) ..... 105220120 U

(51) Int. Cl.
*A47G 9/10* (2006.01)

(52) U.S. Cl.
CPC ..... *A47G 9/109* (2013.01); *A47G 9/1036* (2013.01); *A47G 2009/1018* (2013.01)

(58) Field of Classification Search
CPC ..... A47G 9/109; A47G 9/1036; A47G 2009/1018
See application file for complete search history.

(56) References Cited

U.S. PATENT DOCUMENTS

| | | | | |
|---|---|---|---|---|
| 8,161,588 | B1 * | 4/2012 | Anson | A47G 9/109 5/630 |
| 2006/0005314 | A1 * | 1/2006 | Lee | A47G 9/1081 5/644 |
| 2009/0139031 | A1 * | 6/2009 | Davis | A47G 9/10 5/639 |
| 2014/0026323 | A1 * | 1/2014 | Bowers | A47G 9/10 5/636 |
| 2014/0101854 | A1 * | 4/2014 | Watson | A47G 9/1045 5/639 |
| 2014/0208515 | A1 * | 7/2014 | Sramek | A47G 9/109 5/640 |
| 2015/0265075 | A1 * | 9/2015 | Liu | A61F 5/56 5/640 |
| 2015/0282647 | A1 * | 10/2015 | Hall | A47G 9/10 5/636 |
| 2017/0128307 | A1 * | 5/2017 | Kim | A47G 9/10 |
| 2017/0156958 | A1 * | 6/2017 | Roh | A47G 9/1081 |
| 2018/0153321 | A1 * | 6/2018 | Oliver | A47G 9/0253 |
| 2018/0256387 | A1 * | 9/2018 | Anderson | A47G 9/1081 |
| 2018/0303259 | A1 * | 10/2018 | Glatt | A47G 9/10 |
| 2018/0317677 | A1 * | 11/2018 | Genao | A47G 9/1045 |

* cited by examiner

*Primary Examiner* — Eric J Kurilla
(74) *Attorney, Agent, or Firm* — Li & Cai Intellectual Property (USA) Office

(57) ABSTRACT

A health pillow includes a supine portion and two side-lying portions symmetrically arranged on the two opposite sides of the supine portion. Each of the side-lying portions has a front surface. The supine portion has a supporting protrusion extending beyond the two front surfaces, and the supporting protrusion has a flat surface extending outwardly and away from the two front surfaces. Whereby, the health pillow can help people to get better sleep quality.

11 Claims, 5 Drawing Sheets

HEALTH PILLOW

BACKGROUND OF THE INVENTION

1. Field of the Invention

The instant disclosure relates to a pillow for daily use, and more particularly to a multi-function health pillow.

2. Description of Related Art

With the improvement of living standards, more and more pay attention to health and quality of life. As we know that for having good health and quality of life, adequate sleep is a key factor. Generally, people spend one-third time in sleeping every day, a good sleep can make people feel energetic all day and is helpful for the human body's metabolism and detoxification.

Many people are troubled with sleep due to busy life style. In recent years, memory foam pillows have become more and more popular. The memory foam pillows have a substantially continuous concave shape that generally matches the shape of the head, neck and even shoulders of a user, such that the user's head, neck and/or shoulders can be prevented from keeping in a wrong position for a long time, and thus to improve sleep quality. However, people have different body sizes and shapes and different physical conditions, for example, their cervical areas and profiles have different heights and positions with respect to the ground when lying on the ground. The memory foam pillows may not suitable for its users in all sleep positions, sleeping posture will cause the muscles at vertebral both sides in asymmetrical unbalanced tension respectively that likely incurs physical phenomenon in fatigue and exhaustion, convulsion or neck-stiffness.

Besides, the user's head is in direct contact with a head-supporting upper surface of a conventional pillow while sleeping, and this will cause bad heat dissipation effect and result in feeling uncomfortable in summer. Also, when the user lies on the side sleeping with an ear on the conventional pillow, the downward force due to the head weight will causes an uncomfortable feeling of stuffiness in the ear and even dizziness and tinnitus.

In summary, unhealthy sleep or insomnia is heavily harmful to them on physiology and psychology. There is an urgent need to develop a pillow which can meet the requirements of people of various body types and promote the user's comfort and sleep quality.

SUMMARY OF THE INVENTION

The present invention is invented so as to solve the above conventional problems and has an object to provide a health pillow which not only can achieve the functions of health care but also can solve the problems on use due to bad heat dissipation.

In order to achieve the aforementioned objects, according to an embodiment of the instant disclosure, the health pillow includes a supine portion and two side-lying portions symmetrically arranged on the two opposite sides of the supine portion. Each of the two side-lying portions has a front surface, and the supine portion has a supporting protrusion extending beyond the two front surfaces. The supporting protrusion has a flat surface extending outwardly and away from the two front surfaces.

In one embodiment, each of the two opposite sides of the supporting protrusion has a downwardly-inclined ramp structure, and the two downwardly-inclined ramp structures respectively connect to the two front surfaces.

In one embodiment, wherein one end of the supporting protrusion away from the two front surfaces is formed with a tip structure having an inclined surface extending inwardly toward the two front surfaces.

In one embodiment, the supine portion has a first cavity, and each of the side-lying portions has a second cavity.

In one embodiment, the supine portion has a head-receiving recess, and the first cavity is below the head-receiving recess.

In one embodiment, each of the second cavities is positioned to support a user's head.

In one embodiment, the head-receiving recess has a depth in the range between 1 cm and 3 cm, the first cavity has a height in the range between 1 cm and 3 cm, and the second cavity has a height in the range between 1 cm and 3 cm.

In one embodiment, the supine portion has at least one first ventilation channel extending along a length direction thereof, and one end of the at least one first ventilation channel is in fluid connection with the first cavity and the other end of the at least one first ventilation channel is at a rear surface of the supine portion.

In one embodiment, each of the side-lying portions has at least one second ventilation channel extending along a length direction thereof, and one end of the at least one second ventilation channel is in fluid connection with the corresponding second cavity and the other end of the at least one second ventilation channel is at a rear surface the corresponding side-lying portion.

In one embodiment, each of the side-lying portions has a height greater than or equal to that of the supine portion.

In one embodiment, the supine portion has a height in the range between 3 cm and 22 cm and each of the side-lying portions has a height in the range between 3 cm and 24 cm.

In one embodiment, the supporting protrusion has a length in the range between 4 cm and 200 cm and a width in the range between 3 cm and 28 cm.

Based on the above, compared with the conventional health pillow, the present invention has the following advantages: the health pillow according to the instant embodiment has a supporting protrusion extending beyond the front surfaces of the two side-lying portions, and the supporting protrusion has a flat surface extending outwardly and away from the front surfaces. Therefore, the health pillow can meet the requirements of people of various body types and promote the user's comfort and sleep quality.

To further understand the techniques, means and effects of the instant disclosure, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DETAILED DESCRIPTION OF THE PREFERRED EMBODIMENTS

Embodiments of a health pillow according to the instant disclosure are described herein. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Notably, the terms first, second, third, etc., may be used herein to describe various elements or signals, but these signals should not be affected by such elements or terms. Such terminology is used to distinguish one element from another or a signal with another signal. Further, the term "or" as used herein in the case may include any one or combinations of the associated listed items.

Figure 1:
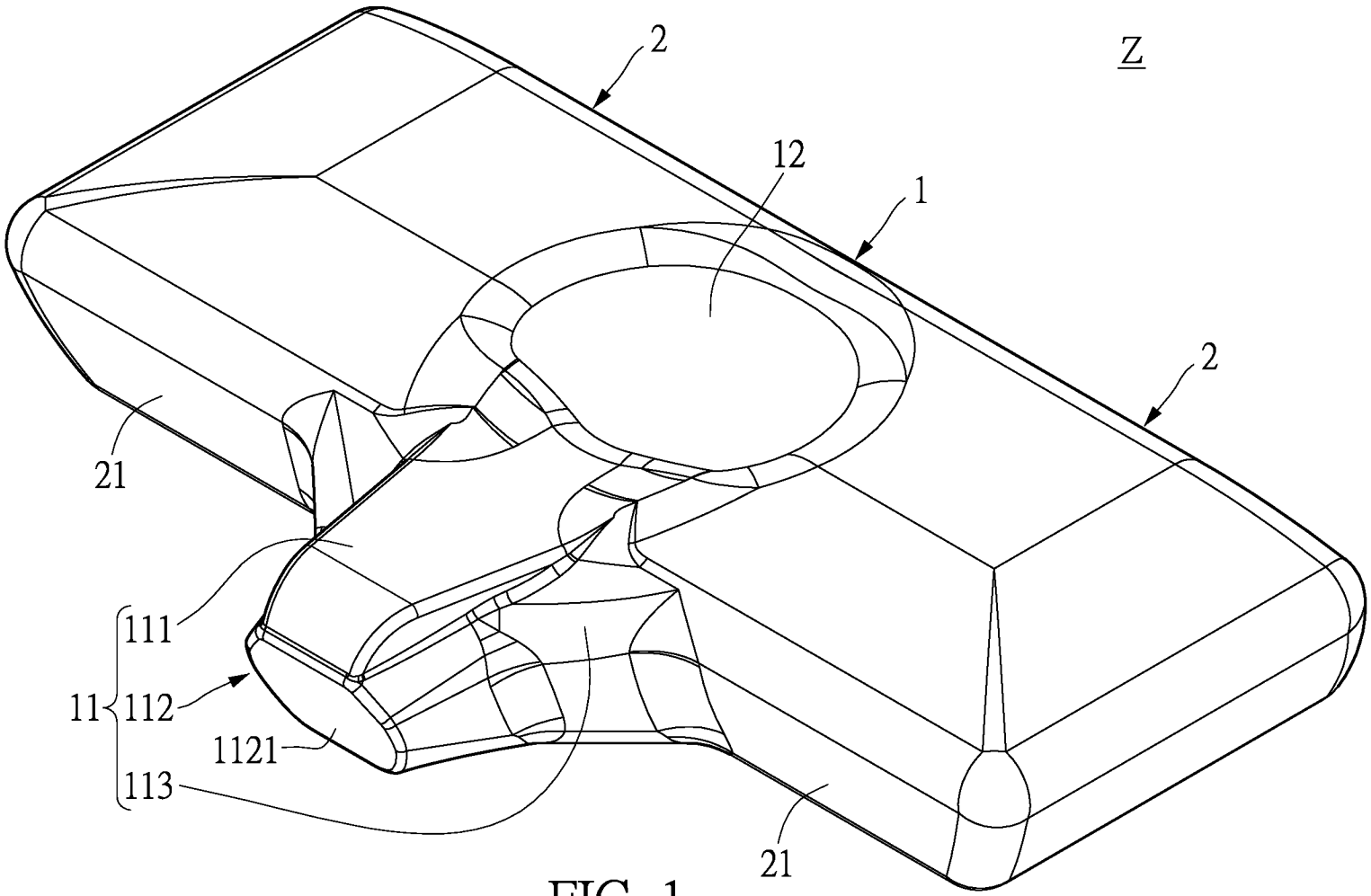
FIG. 1 is a three-dimensional view of the health pillow of the instant disclosure.
Figure 2:
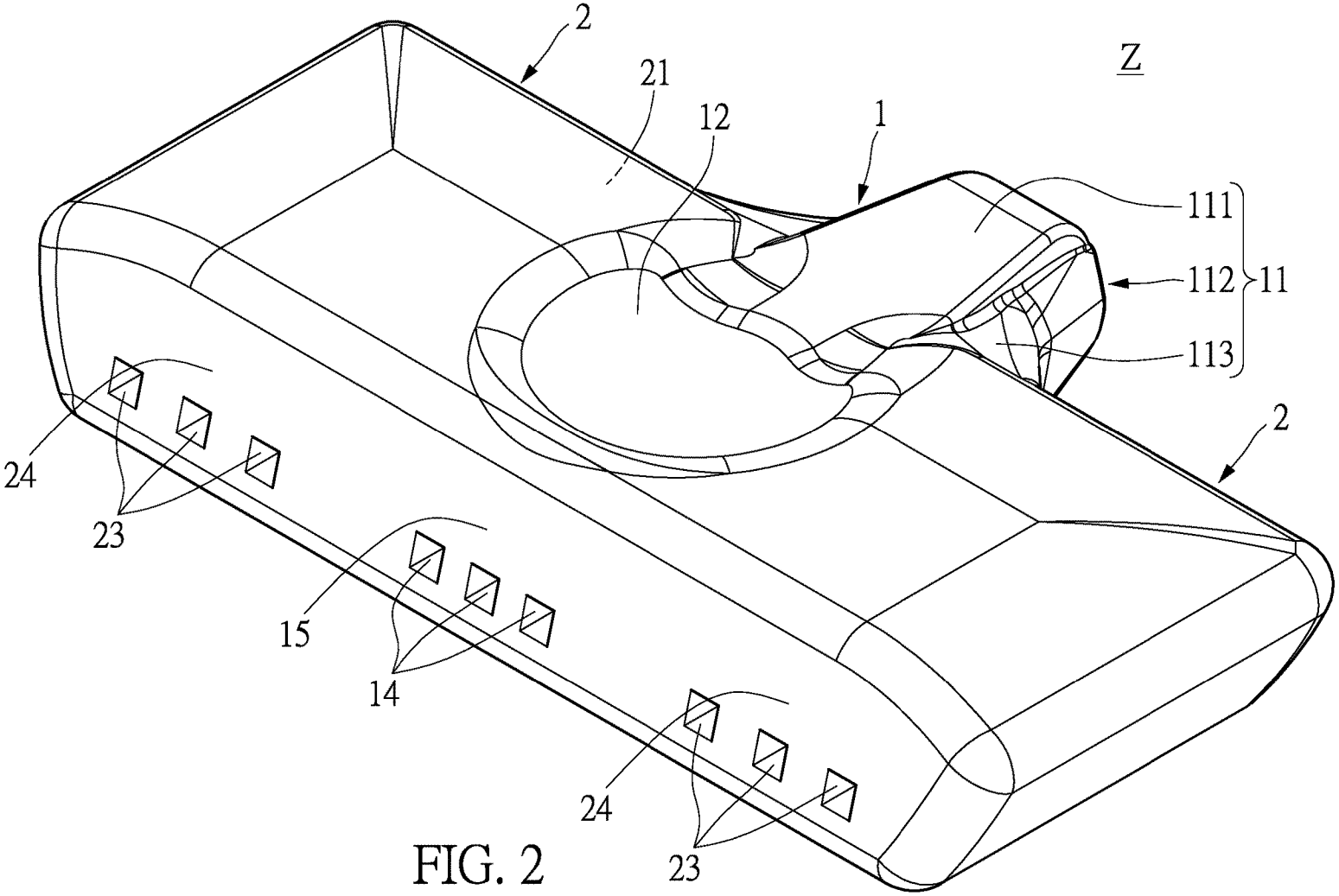
FIG. 2 is another three-dimensional view of the health pillow of the instant disclosure.

Referring to FIGS. 1 and 2, these are three-dimensional diagrams viewed from different angles. The present invention provides a health pillow Z which includes a supine portion 1 and two side-lying portions 2 symmetrically arranged on both sides of the supine portion 1. When the user lies on one's back sleep posture, his/her head can be placed on the supine portion 1. When the user lies on one's side sleep posture, his/her head can be placed on one of the two side-lying portions 2. In practice, the health pillow Z may be made of any suitable cushion material such as foam, memory foam, latex, silk, cotton, and plastic particles. The health pillow Z may include at least one airbag thereby having a predetermined shape when the airbag is in an inflated state.

For the instant embodiment, the supine portion 1 and the two side-lying portions 2 may be formed in a regular shape, and each of the two side-lying portions 2 may have a height greater than or equal to that of the supine portion 1. Preferably, each of the two side-lying portions 2 is higher than the supine portion 1 to offer suitable height for single side shoulder so that the user's head and neck can be exactly placed on and closely supported by one of the two side-lying portions 2. The supine portion 1 may have a height in the range between 3 cm and 22 cm, preferably between 6 cm and 15 cm. Each of the two side-lying portions 2 may have a height in the range between 3 cm and 24 cm, preferably between 8 cm and 18 cm.

Please note that the health pillow Z is radically different from the conventional health pillow. Specifically, the supine portion 1 has a supporting protrusion 11 extending beyond a front surface 21 of each of the two side-lying portions 2, and the supporting protrusion 11 has a flat surface 111 extending outwardly and away from the two front surfaces 21. The supporting protrusion 11 may have a length in the range between 4 cm and 200 cm, preferably between 6 cm and 20 cm, and a width in the range between 3 cm and 28 cm.

Further, the supporting protrusion 11 for supporting the user's neck is not be formed with any recess structure matching the physiological curvature of the human neck. Notably, a front end (one end away from the two front surfaces 21) of the supporting protrusion 11 is formed with a tip structure 112 having an inclined surface 1121 inwardly toward the two front surfaces 21. Accordingly, a buffer space of deformation can be provided by the tip structure 112 when the user's neck is placed on the supporting protrusion 11, such that the user's neck can be closely supported and the stress/muscle tension of the user's neck can be relieved.

Please note that each of the two opposite sides of the supporting protrusion 11 can be provided with a downwardly-inclined ramp structure 113 having a height slightly lower than that thereof, wherein the height of each of the two downwardly-inclined ramp structure 113 gradually decreases along a direction outwards from the two front surfaces 21. Accordingly, when the user changes the sleep posture from a supine position (lies on one's back) to a lateral position (lies on one's side), the motion of the user's neck cannot be restricted, and thus to allow the user to easily change his/her posture during sleep and thereby helping to reduce neck fatigue to promote the sleep quality. Further, the two downwardly-inclined ramp structures 113 respectively connect to the front surfaces 21 of the two side-lying portions 2 such that the structural stability of the health pillow Z can be improved.

To enhance the user's comfort for having good sleep quality, the supine portion 1 has a head-receiving recess 12. Thus, the user's head can remain in contact with the head-receiving recess 12 to limit a head movement to prevent crick in the neck. For the instant embodiment, the head-receiving recess 12 may have a shape matching the shape of a head contact portion of the user's head and a depth in the range between 1 cm and 3 cm.

Figure 3:
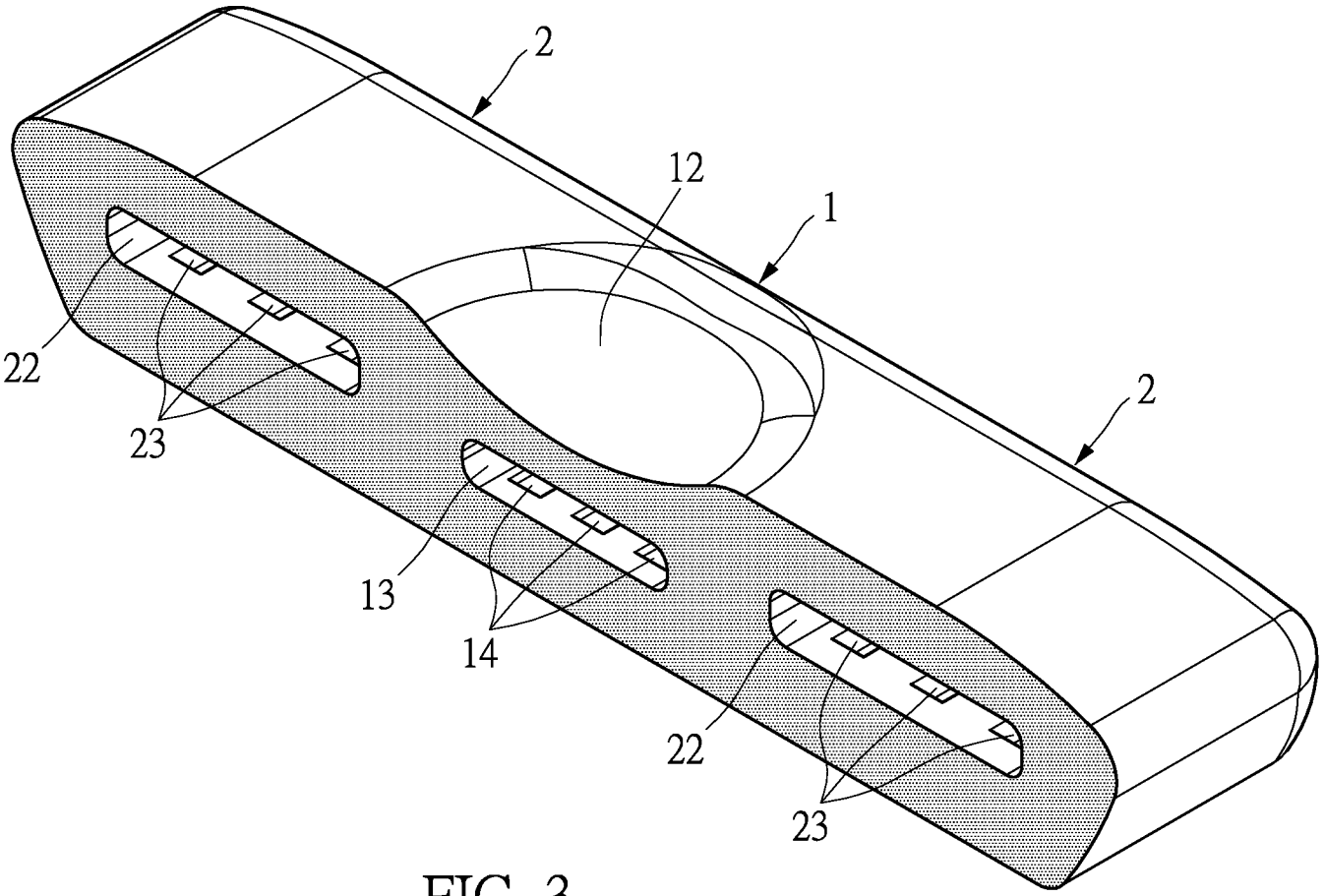
FIG. 3 is a local three-dimensional view of the health pillow of the instant disclosure.
Figure 4:
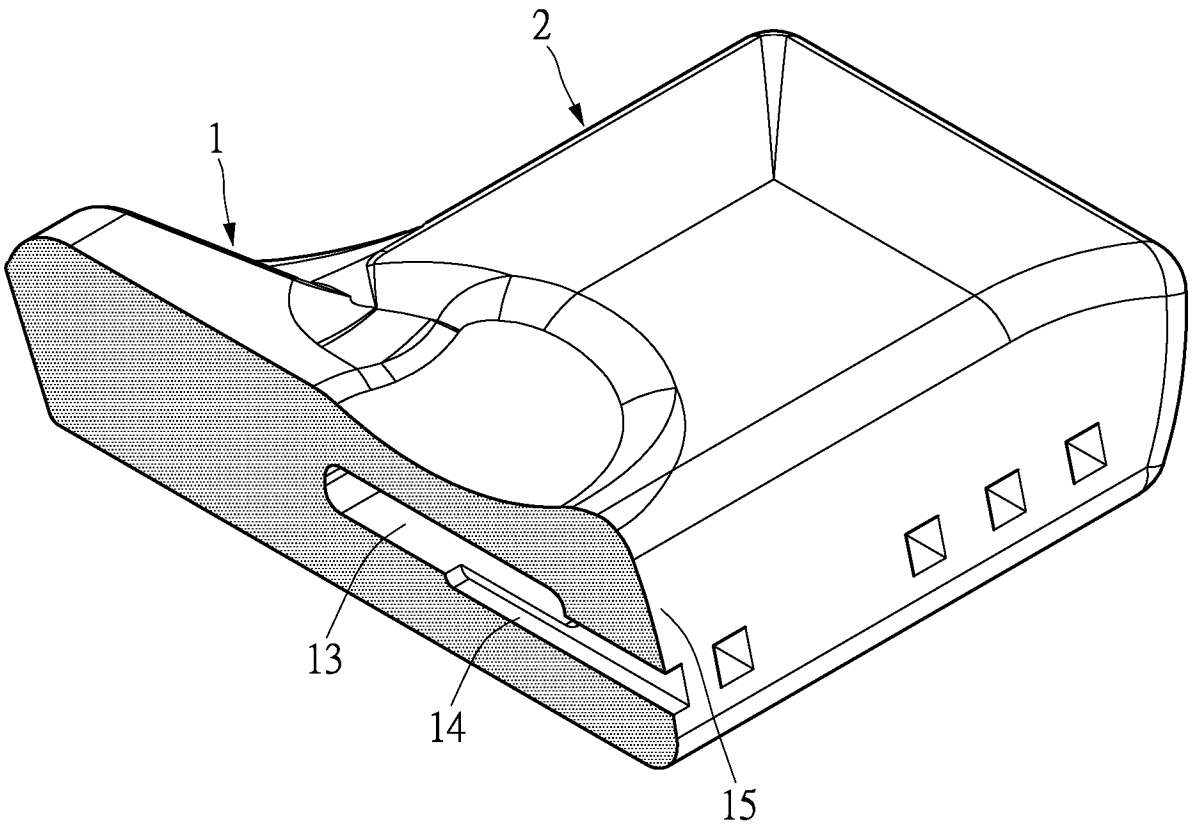
FIG. 4 is another local three-dimensional view of the health pillow of the instant disclosure.
Figure 5:
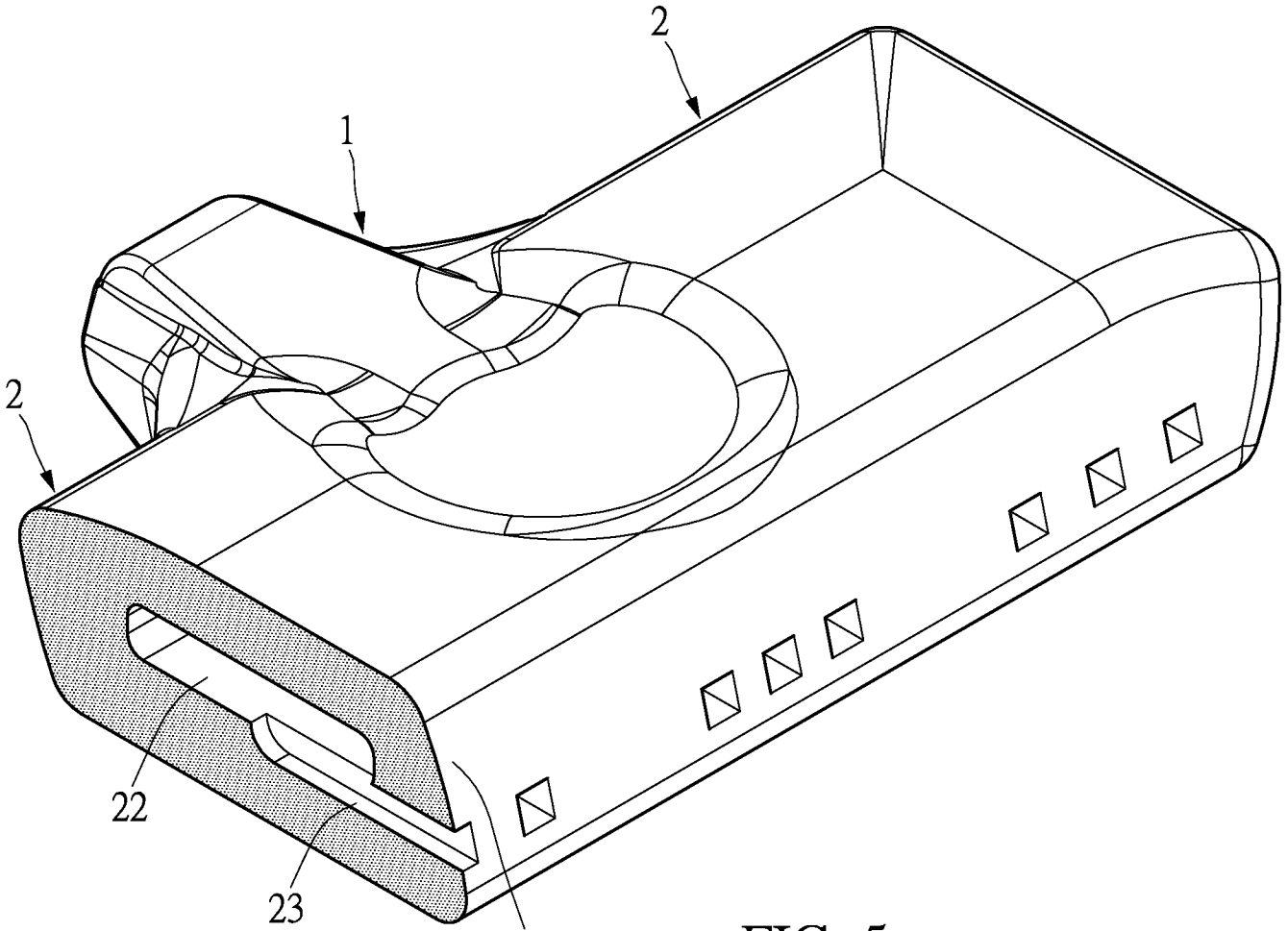
FIG. 5 is still another local three-dimensional view of the health pillow of the instant disclosure.

Referring to FIGS. 3 to 5, the supine portion 1 may further have a first cavity 13 below the head-receiving recess 12, and each of the side-lying portions 2 may have a second cavity 22 positioned to support the user's head. For the instant embodiment, the first and second cavity 13, 22 may have a shape matching the shape of a head contact portion of the user's head and a height in the range between 1 cm and 3 cm. Accordingly, when the user is in a supine or in a lateral sleep position, the user's head is exactly placed on and closely supported by the supine portion 1 or one of the two side-lying portions 2 completely and side and the user's ear will be not pressed. Also, the stress due to subsidence deformation with the user's head on the pillow can be reduced to avoid impacting the head blood circulation.

Further, the supine portion 1 may have at least one first ventilation channel 14 extending along a length direction thereof, wherein one end of the at least one first ventilation channel 14 is in fluid connection with the first cavity 13 and the other end of the at least one first ventilation channel 14 is at a rear surface 15 the supine portion 1. Each of the side-lying portions 2 may have at least one second ventilation channel 23 extending along a length direction thereof, wherein one end of the at least one second ventilation channel 23 is in fluid connection with the corresponding second cavity 22 and the other end of the at least one second ventilation channel 23 is at a rear surface 24 the corresponding side-lying portions 2. Please note that the first and second ventilation channels 14, 23 have the functions of air permeability and heat dissipation such that heat generated from the user's head can be effectively discharged.

Although the health pillow Z shown in FIG. 1 have three first ventilation channels 14 and three second ventilation channels 23, but in various embodiments, the amount of the first and second ventilation channels 14, 23 may be one, two, or more than three. Embodiments are not limited to any particular number of the first and second ventilation channels 14, 23.

Based on the above, compared with the conventional health pillow, the present invention has the following advantages:

First, the health pillow according to the instant embodiment has a supporting protrusion extending beyond the front surfaces of the two side-lying portions symmetrically arranged on the two opposite sides thereof, and the supporting protrusion has a flat surface extending outwardly and away from the front surfaces. Therefore, the health pillow can meet the requirements of people of various body types and promote the user's comfort and sleep quality.

Further, the front end of the supporting protrusion is formed with a tip structure which can provide a buffer space of deformation with the user's neck thereon when the user lies on one's side sleep posture. Accordingly, the user's neck can be closely supported and the stress/muscle tension of the user's neck can be relieved.

Further, each of the two opposite sides of the supporting protrusion can be provided with a downwardly-inclined ramp structure. Accordingly, the user can easily change his/her posture during sleep.

Further, the supine portion can be provided with a first cavity below the head-receiving recess, and each of the two side-lying portions can be provided with a second cavity positioned to support the user's head. Accordingly, when the user lies on one's back or side sleep posture, the health pillow can have a respectively desired surface subsidence according to people of different weight. Therefore, when the user lies on one's back or side sleep posture, the user's head is exactly placed on and closely supported by the supine portion or one of the two side-lying portions completely and the user's ear will be not pressed. Also, the stress due to subsidence deformation with the user's head on the pillow can be reduced to avoid impacting the head blood circulation.

Finally, the supine portion can be provided with one or more first ventilation channels in fluid connection with the first cavity and each of the side-lying portions can be provided with one or more second ventilation channels in fluid connection with the corresponding second cavity. Accordingly, heat generated from the user's head while sleeping can be effectively discharged.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A health pillow comprising a supine portion and two side-lying portions symmetrically arranged on the two opposite sides of the supine portion, wherein each of the side-lying portions has a front surface, the supine portion has a supporting protrusion extending beyond the front surfaces, and the supporting protrusion has a length between 6 cm and 20 cm and has a flat surface extending outwardly and away from the front surfaces, wherein the supporting protrusion has a front end away from the front surfaces which is formed with a tip structure having an inclined surface, and wherein the supine portion has a head-receiving recess disposed at a height lower than that of the flat surface and the front end of the supporting protrusion.

2. The health pillow of claim 1, wherein each of two opposite sides of the supporting protrusion has a downwardly-inclined ramp structure, and the two downwardly-inclined ramp structures respectively connect to the two front surfaces.

3. The health pillow of claim 1, wherein each of the side-lying portions has a second cavity.

4. The health pillow of claim 3, wherein the supine portion has a head-receiving recess, and the first cavity is below the head-receiving recess.

5. The health pillow of claim 4, wherein each of the second cavities is positioned to support a user's head.

6. The health pillow of claim 5, wherein the head-receiving recess has a depth in the range between 1 cm and 3 cm, the first cavity has a height in the range between 1 cm and 3 cm, and the second cavity has a height in the range between 1 cm and 3 cm.

7. The health pillow of claim 5, wherein the supine portion has at least one first ventilation channel extending along a length direction thereof, and one end of the at least one first ventilation channel is in fluid connection with the first cavity and the other end of the at least one first ventilation channel is at a rear surface of the supine portion.

8. The health pillow of claim 5, wherein each of the side-lying portions has at least one second ventilation channel extending along a length direction thereof, and one end of the at least one second ventilation channel is in fluid connection with the corresponding second cavity and the other end of the at least one second ventilation channel is at a rear surface of the corresponding side-lying portion.

9. The health pillow of claim 1, wherein each of the side-lying portions has a height greater than or equal to that of the supine portion.

10. The health pillow of claim 9, wherein the supine portion has a height in the range between 3 cm and 22 cm and each of the side-lying portions has a height in the range between 3 cm and 24 cm.

11. The health pillow of claim 1, wherein the supporting protrusion has a length in the range between 4 cm and 200 cm and a width in the range between 3 cm and 28 cm.

* * * * *